US009586238B2

(12) United States Patent
Yu

(10) Patent No.: US 9,586,238 B2
(45) Date of Patent: Mar. 7, 2017

(54) NEEDLE CLEAN DEVICE AND SEALANT COATER HAVING THE DEVICE

(71) Applicant: Shenzhen China Star Optoelectronics Technology Co., Ltd., Shenzhen, Guangdong (CN)

(72) Inventor: Wei Yu, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 289 days.

(21) Appl. No.: 14/384,652

(22) PCT Filed: Sep. 16, 2013

(86) PCT No.: PCT/CN2013/083532

§ 371 (c)(1),
(2) Date: Sep. 11, 2014

(87) PCT Pub. No.: WO2015/035633

PCT Pub. Date: Mar. 19, 2015

(65) Prior Publication Data

US 2016/0236240 A1 Aug. 18, 2016

(30) Foreign Application Priority Data

Sep. 10, 2013 (CN) ..... 2013 1 0410921

(51) Int. Cl.
*B05B 15/02* (2006.01)
*B05C 5/00* (2006.01)
(Continued)

(52) U.S. Cl.
CPC ..... *B08B 1/02* (2013.01); *B05B 15/0208* (2013.01); *B08B 1/001* (2013.01); *B08B 1/005* (2013.01); *B08B 9/023* (2013.01)

(58) Field of Classification Search
USPC ..... 118/302, 300; 134/6, 22.1, 22.11; 15/236.01, 104.04, 105, 93.1, 306.1, 301,
(Continued)

(56) References Cited

U.S. PATENT DOCUMENTS 6,813,804 B2 * 11/2004 Kim ..... B08B 1/00 15/301
2003/0066546 A1 * 4/2003 Bibeault ..... B08B 5/04 134/21

FOREIGN PATENT DOCUMENTS

CN 202600312 U * 12/2012
JP 01056164 A * 3/1989

OTHER PUBLICATIONS

English Translation CN 202600312(U), Dec. 12, 2012.*
Abstract JP-01056164 A, Mar. 3, 1998.*

* cited by examiner

*Primary Examiner* — Yewebdar Tadesse
(74) *Attorney, Agent, or Firm* — Andrew C. Cheng

(57) ABSTRACT

The present invention provides a needle clean device and a sealant coater having the device. The needle clean device comprises: two opposing guide tracks (52), two stand bars (56) respectively and slidably installed on the two guide tracks (52), two motors (54) respectively fixedly connected to the two stand bars (56) and two opposing catches (57) respectively located on the two stand bars (56), and dents (69) are respectively located at opposing side surfaces of the two catches (57), and the stand bars (56) can be driven by the motors (54) to move back and forth along the guide tracks (52) to drive the two catches (57) close to or depart from each other and to close the two dents (69) to form a hole or to open the two dents (69). According to the needle clean device located by the present invention, the catches are utilized to automatically scrape the sealant accumulated on
(Continued)

the needle without manual clean. The work efficiency is raised and the production quality is promoted.

15 Claims, 4 Drawing Sheets

(51) Int. Cl.
*B08B 1/02* (2006.01)
*B08B 1/00* (2006.01)
*B08B 9/023* (2006.01)

(58) Field of Classification Search
USPC ..... 15/319; 347/21–36
See application file for complete search history.

NEEDLE CLEAN DEVICE AND SEALANT COATER HAVING THE DEVICE

FIELD OF THE INVENTION

The present invention relates to a liquid crystal display production field, and more particularly to an auto clean device and a sealant coater having the device.

BACKGROUND OF THE INVENTION

Today, the technology development is explosive and tones of information product have been old before it is found to be new. The earliest displays are Cathode Ray Tube (CRT) displays. It occupies huge space and its power consumption is high. Moreover, it can jeopardize the body to the user of the display due to the generated radiation. Therefore, the displays in the present market, the Liquid Crystal Displays (LCD) have been gradually replaced the old CRT displays.

The liquid crystal display possesses advantages of being ultra thin, power saved and radiation free. It has been widely utilized. Most of LCDs in the present market are backlight type LCDs which include a liquid crystal display panel and a backlight module. The working theory of the liquid crystal display panel is to position liquid crystal molecules between two parallel glass substrates. By conducting the circuits of the glass substrates to control the liquid crystal molecules to change the directions to refract out the light of the backlight module for generating images.

The present liquid crystal display manufacture skill has been well developed. The manufacture production of the liquid crystal displays requires three complicated processes of "an Array process of the front end, a cell process in the middle, a module assembly process of back end". The patterned active array substrate (TFT substrate) and color filter substrate (CF substrate) are respectively manufactured in advance. Then, the two substrates are laminated in the process of One Drop Filling (ODF). The side frame sealant is coated on the corresponding positions on the two substrates. The liquid crystal material is injected inside the side frame sealant of the active array substrate which has been coated with the side frame sealant. Then, the two substrates are laminated and UV light is utilized to irradiate the side frame sealant while the side frame sealant is heated. Accordingly, the side frame sealant is solidified and the liquid crystal material is sealed.

In general, the side frame sealant is coated by using a sealant coater. The sealant is easily accumulated on the needle of the sealant coater after a certain amount of substrates are coated. As shown in FIG. 1, the figure shows a syringe 100, a needle 200 and the accumulated sealant 300. The accumulated sealant 300 can cause the influence below:

a. Abnormity happens and a gap appears during the period that the sealant coater is coating the side frame sealant. The coater will stop. The needle 200 needs to be cleaned with a clean wiper and then the coating can be proceeded. The discontinuously accomplished coating operation can cause influence to the production quality.

b. The needle 200 of the sealant coater will accelerate or decelerate in its motions. The accumulated sealant 300 may drop in the display area of the liquid crystal display. The production has to be wasted.

c. The door of the coater has to open when the needle 200 of the sealant coater is cleaned. The needle 200 is manually cleaned with the clean wiper. The risk of particle issue for the production is raised.

SUMMARY OF THE INVENTION

An objective of the present invention is to provide a needle clean device to automatically clean needles by settings without manual clean and raise the work efficiency.

Another objective of the present invention is to provide a sealant coater having a needle clean device to automatically clean needles by settings without manual clean and raise the work efficiency. Meanwhile, the particle issue caused by opening the door of the coater to clean the needles can be diminished and the bad influence to the productions due to the sealant accumulated on the needles of the sealant coater can be reduced.

For realizing the aforesaid objective, the present invention provides a needle clean device, comprising two opposing guide tracks, two stand bars respectively and slidably installed on the two guide tracks, two motors respectively fixedly connected to the two stand bars and two opposing catches respectively located on the two stand bars, and dents are respectively located at opposing side surfaces of the two catches, and the stand bars can be driven by the motors to move back and forth along the guide tracks to drive the two catches close to or depart from each other and to close the two dents to form a hole or to open the two dents, and a needle to be cleaned is moved between the two dents when the two dents are opened and next, the two catches are moved to close to each other by driven with the two motors until the needle to be cleaned is accommodated in the hole formed by the two dents, and then the needle to be cleaned is moved outward along a hole axis line, the catches scrape residual sealant on the needle to be cleaned during the process that the needle to be cleaned is moved outward to accomplish a cleaning action for the needle to be cleaned.

Each of the catches comprises: a connecting part which one end is connected to the stand bar and a cleaning part which is connected to the other end of the connecting part, and each of the cleaning part comprises a bottom part and a top part connecting to the bottom part, and opposing side surfaces of the two bottom parts of the cleaning parts are cants, and the two dents are respectively located at the middle of the opposing side surfaces of the two top parts of the cleaning parts, and the two bottom parts of the two cleaning parts have wedge appearances, and the two dents appear as symmetric semicircles.

The material of the two catches is no dust plastics and the aperture of the hole formed by the two closed dents is larger than a diameter of the needle to be cleaned.

The needle clean device further comprises a container between the two guide tracks, and the container is employed to accept the residual sealant scraped down from the needle to be cleaned.

The present invention further provides a sealant coater having a needle clean device, comprising: a sealant coating device and the needle clean device located on the sealant coating device, and the sealant coating device comprises a coating assembly, and the coating assembly comprises a coating head, and the coating head comprises a syringe and a needle installed at one end of the syringe; the needle clean device comprises two opposing guide tracks, two stand bars respectively and slidably installed on the two guide tracks, two motors respectively fixedly connected to the two stand bars and two opposing catches respectively located on the two stand bars, and dents are respectively located at opposing side surfaces of the two catches, and the stand bars can be driven by the motors to move back and forth along the guide tracks to drive the two catches close to or depart from each other and to close the two dents to form a hole or to open the two dents, and a needle to be cleaned is moved between the two dents when the two dents are opened and next, the two catches are moved to close to each other by driven with the two motors until the needle to be cleaned is accommodated in the hole formed by the two dents, and then the needle to be cleaned is moved outward along a hole axis line, the catches scrape residual sealant on the needle to be cleaned during the process that the needle to be cleaned is moved outward to accomplish a cleaning action for the needle to be cleaned.

The sealant coating device further comprises: a platform, and an outer frame located at periphery of the platform, and the coating assembly is installed on the outer frame, and the platform fixes a substrate by vacuum suction; the coating assembly comprises a portal frame installed on the outer frame and two coating head symmetrically installed on the portal frame; the guide tracks of the needle clean device are installed on the outer frame relative to the coating assembly, and the needle clean device further comprises a container between the two guide tracks, and the container is employed to accept the residual sealant scraped from the needle to be cleaned.

The sealant coater having the needle clean device comprises two needle clean devices, and the two needle clean devices are symmetrically installed in middle positions of two opposing sides of the outer frame; the portal frame comprises two mounting supports and coating head installation parts connected to the two mounting supports, and lengths of the coating head installation part is larger than a distance between the two needle clean devices.

Each of the catches comprises: a connecting part which one end is connected to the stand bar and a cleaning part which is connected to the other end of the connecting part, and each of the cleaning part comprises a bottom part and a top part connecting to the bottom part, and opposing side surfaces of the two bottom parts of the cleaning parts are cants, and the two dents are respectively located at the middle of the opposing side surfaces of the two top parts of the cleaning parts, and the two bottom parts of the two cleaning parts have wedge appearances, and the two dents appear as symmetric semicircles.

The material of the two catches is no dust plastics and the aperture of the hole formed by the two closed dents is larger than a diameter of the needle to be cleaned.

The two mounting supports of the portal frame at the two opposing sides of the outer frame respectively comprise a coating device guide track, and the portal frame is installed on the outer frame with the two coating device guide tracks, and the portal frame is moved back and forth on the coating device guide track along a first direction, and the two coating heads are moved back and forth on the portal frame along a second direction which is perpendicular to the first direction, and the coating heads are moved up and down on the portal frame along a direction perpendicular to a plane constructed by the first direction and the second direction.

The present invention further provides a sealant coater having a needle clean device, comprising: a sealant coating device and the needle clean device located on the sealant coating device, and the sealant coating device comprises a coating assembly, and the coating assembly comprises a coating head, and the coating head comprises a syringe and a needle installed at one end of the syringe; the needle clean device comprises two opposing guide tracks, two stand bars respectively and slidably installed on the two guide tracks, two motors respectively fixedly connected to the two stand bars and two opposing catches respectively located on the two stand bars, and dents are respectively located at opposing side surfaces of the two catches, and the stand bars can be driven by the motors to move back and forth along the guide tracks to drive the two catches close to or depart from each other and to close the two dents to form a hole or to open the two dents, and a needle to be cleaned is moved between the two dents when the two dents are opened and next, the two catches are moved to close to each other by driven with the two motors until the needle to be cleaned is accommodated in the hole formed by the two dents, and then the needle to be cleaned is moved outward along a hole axis line, the catches scrape residual sealant on the needle to be cleaned during the process that the needle to be cleaned is moved outward to accomplish a cleaning action for the needle to be cleaned;

wherein the sealant coating device further comprises: a platform, and an outer frame located at periphery of the platform, and the coating assembly is installed on the outer frame, and the platform fixes a substrate by vacuum suction; the coating assembly comprises a portal frame installed on the outer frame and two coating head symmetrically installed on the portal frame; the guide tracks of the needle clean device are installed on the outer frame relative to the coating assembly, and the needle clean device further comprises a container between the two guide tracks, and the container is employed to accept the residual sealant scraped from the needle to be cleaned.

The sealant coater having the needle clean device comprises two needle clean devices, and the two needle clean devices are symmetrically installed in middle positions of two opposing sides of the outer frame; the portal frame comprises two mounting supports and coating head installation parts connected to the two mounting supports, and lengths of the coating head installation part is larger than a distance between the two needle clean devices.

Each of the catches comprises: a connecting part which one end is connected to the stand bar and a cleaning part which is connected to the other end of the connecting part, and each of the cleaning part comprises a bottom part and a top part connecting to the bottom part, and opposing side surfaces of the two bottom parts of the cleaning parts are cants, and the two dents are respectively located at the middle of the opposing side surfaces of the two top parts of the cleaning parts, and the two bottom parts of the two cleaning parts have wedge appearances, and the two dents appear as symmetric semicircles.

The material of the two catches is no dust plastics and the aperture of the hole formed by the two closed dents is larger than a diameter of the needle to be cleaned.

The two mounting supports of the portal frame at the two opposing sides of the outer frame respectively comprise a coating device guide track, and the portal frame is installed on the outer frame with the two coating device guide tracks, and the portal frame is moved back and forth on the coating device guide track along a first direction, and the two coating heads are moved back and forth on the portal frame along a second direction which is perpendicular to the first direction, and the coating heads are moved up and down on the portal frame along a direction perpendicular to a plane constructed by the first direction and the second direction.

The benefits of the present invention are: in the needle clean device and the sealant coater having the device, by utilizing the needle clean device located on the outer frame and utilizing the catches to automatically scrape the sealant accumulated on the needle after a certain amount of substrate is coated by settings without manual clean and raise the work efficiency. Meanwhile, the particle issue caused by opening the door of the coater to clean the needles can be diminished and the bad influence to the productions due to the sealant accumulated on the needles of the sealant coater can be reduced. The production quality is promoted.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution, as well as beneficial advantages, of the present invention will be apparent from the following detailed description of an embodiment of the present invention, with reference to the attached drawings.

In drawings.

DETAILED DESCRIPTION OF PREFERRED EMBODIMENTS

Figure 1:
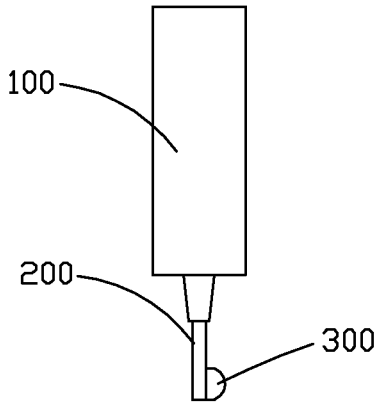
FIG. 1 is a diagram showing sealant accumulated on a needle of a coating head according to prior art.
Figure 2:
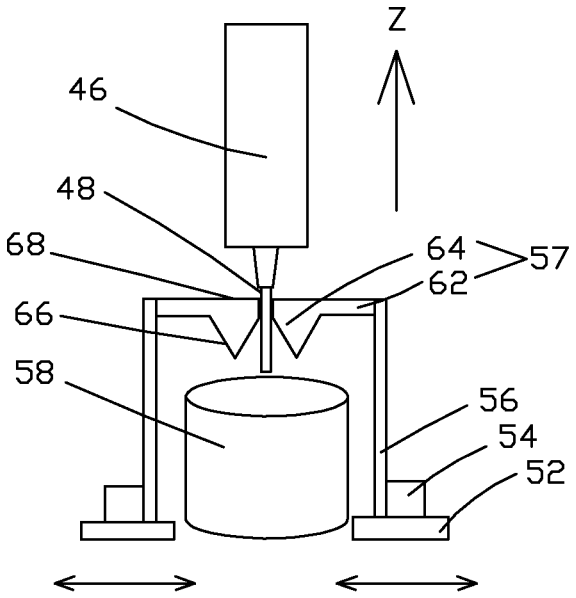
FIG. 2 is a diagram of a needle clean device when catches are closed according to the present invention.
Figure 3:
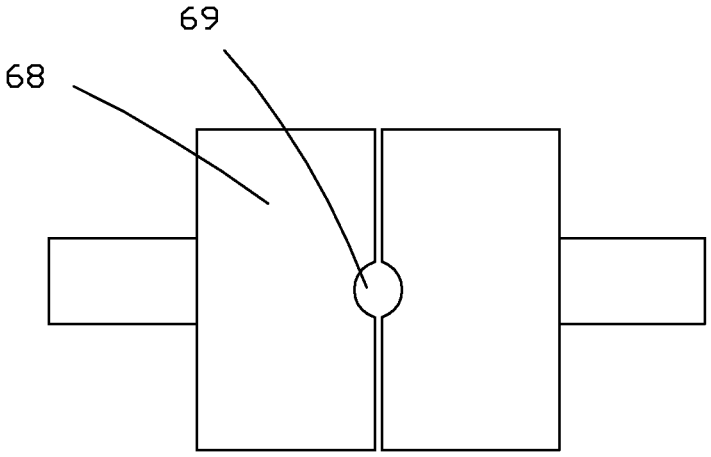
FIG. 3 is a top view diagram of the needle clean device when the catches are closed according to the present invention.
Figure 4:
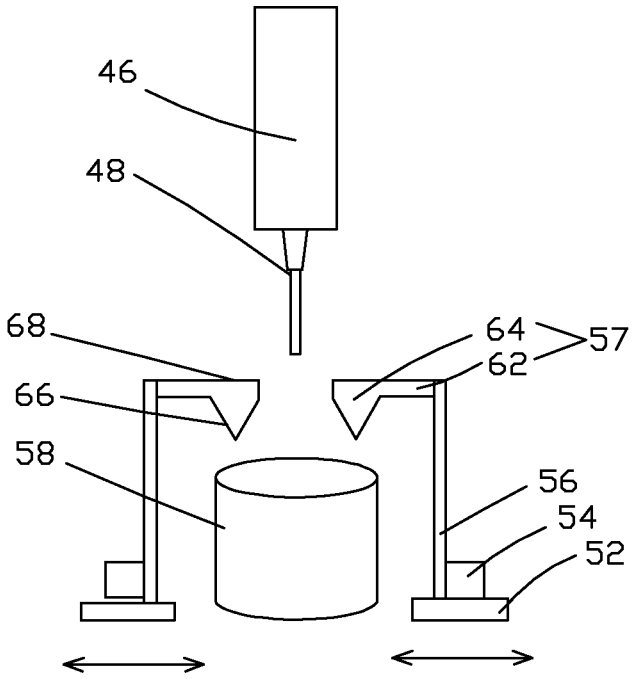
FIG. 4 is a diagram of a needle clean device when catches are opened according to the present invention.
Figure 5:
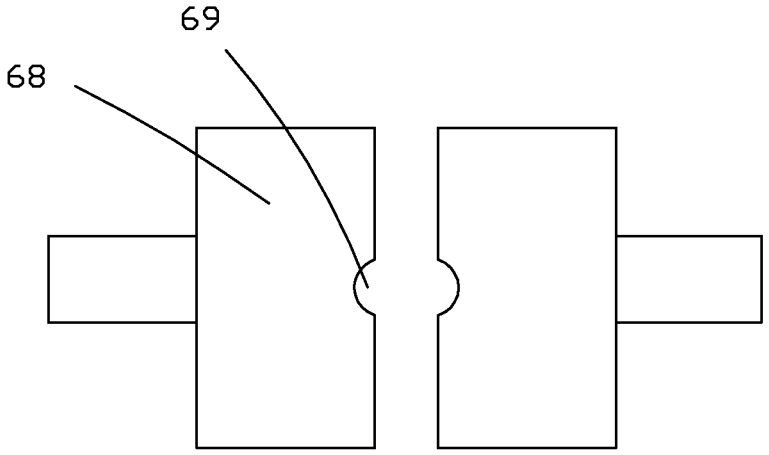
FIG. 5 is a top view diagram of the needle clean device when the catches are opened according to the present invention.

Embodiments of the present invention are described in detail with the technical matters, structural features, achieved objects, and effects with reference to the accompanying drawings as follows.

Please refer from FIG. 2 to FIG. 5. The present invention provides a needle clean device to automatically clean needles by settings without manual clean and raise the work efficiency. The needle clean device specifically comprises: two opposing guide tracks 52, two stand bars 56 respectively and slidably installed on the two guide tracks 52, two motors 54 respectively fixedly connected to the two stand bars 56 and two opposing catches 57 respectively located on the two stand bars 56, and dents 69 are respectively located at opposing side surfaces of the two catches 57, and the stand bars 56 can be driven by the motors 54 to move back and forth along the guide tracks 52 to drive the two catches 57 close to or depart from each other and to close the two dents 69 to form a hole or to open the two dents 69, and a needle 48 to be cleaned is moved between the two dents 69 when the two dents 69 are opened and next, the two catches 57 are moved to close to each other by driven with the two motors 54 until the needle 48 to be cleaned is accommodated in the hole formed by the two dents 69, and then the needle 48 to be cleaned is moved outward along a hole axis line, the catches 57 scrape residual sealant on the needle 48 to be cleaned during the process that the needle 48 to be cleaned is moved outward to accomplish a cleaning action for the needle 48 to be cleaned.

The needle clean device further comprises a container 58 between the two guide tracks 52, and the container 58 is employed to accept the residual sealant scraped down from the needle 48 to be cleaned. The container 58 can be taken out of the needle clean device 50 and cleaned alone.

The material of the two catches 57 is no dust plastics to prevent the influence to the production quality due to the generated dust in use. Each of the catches 57 comprises: a connecting part 62 which one end is connected to the stand bar 56 and a cleaning part 64 which is connected to the other end of the connecting part 62, and each of the cleaning part 64 comprises a bottom part 66 and a top part 68 connecting to the bottom part 66, and opposing side surfaces of the two bottom parts 66 of the cleaning parts 64 are cants. In the present invention, the opposing side surfaces of the two bottom parts 66 of the cleaning parts 64 comprise certain cants. As long as the certain cants capable of allowing the scraped sealant dropped with the cants by gravity and preventing the scraped sealant to be accumulated at places where the catches 57 and the needle 48 to be cleaned can touch, the clean effect will not be influenced.

In this embodiment, the two bottom parts of the two cleaning parts preferably have wedge appearances. The two dents 69 are respectively located at the middle of the opposing side surfaces of the two top parts 68 of the cleaning parts 64. The two dents 69 appear as symmetric semicircles. The two dents are closed to form a hole when the two catches close to each other. The aperture of the hole formed by the two closed dents is larger than a diameter of the needle to be cleaned to prevent the damage to the needle 48 to be cleaned when the catches 57 are closed.

Figure 6:
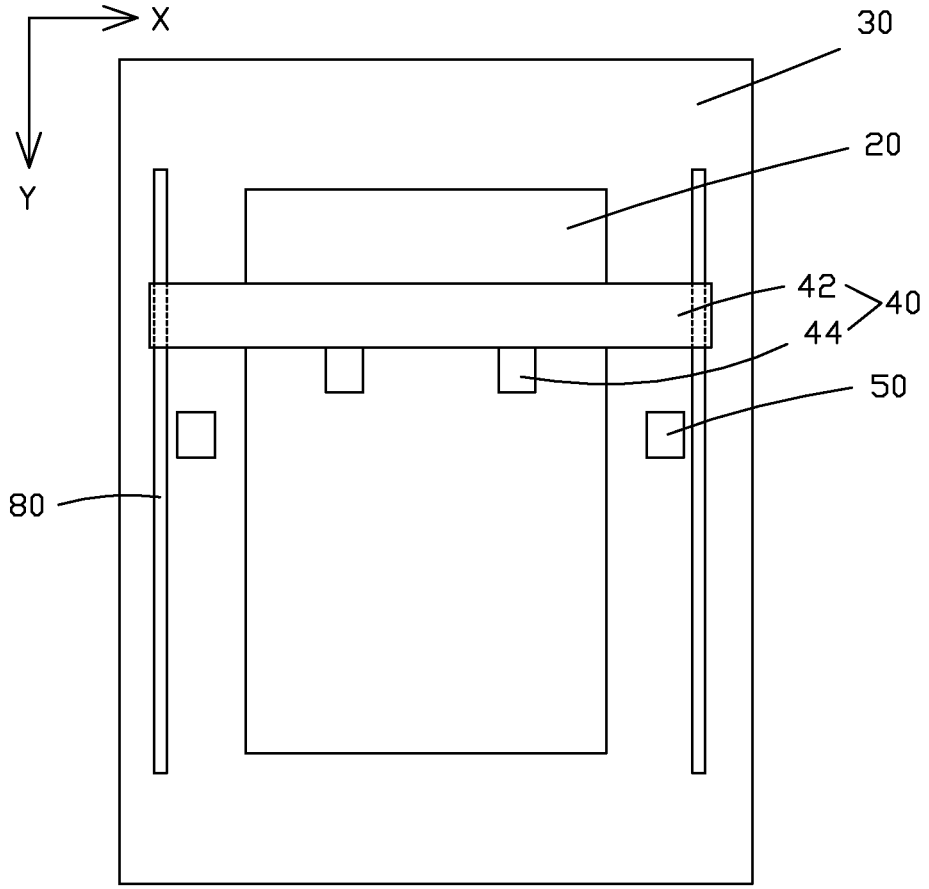
FIG. 6 is a structural diagram of a sealant coater having the needle clean device according to the present invention.

Please refer to FIG. 6 in combination from FIG. 2 to FIG. 5. The present invention provides a sealant coater having the needle clean device. The clean of the needle can be automatically implemented without opening the door of the coater and after a certain amount of substrate is coated by settings to raise the work efficiency. Meanwhile, the particle issue caused by opening the door of the coater to clean the needles can be diminished.

The sealant coater having the needle clean device mainly comprises a sealant coating device and the needle clean device 50 located on the sealant coating device, and the sealant coating device comprises a coating assembly 40, and the coating assembly 40 comprises a coating head 44, and the coating head 44 comprises a syringe 46 and a needle 48 installed at one end of the syringe 46; the needle clean device 50 comprises: two opposing guide tracks 52, two stand bars 56 respectively and slidably installed on the two guide tracks 52, two motors 54 respectively fixedly connected to the two stand bars 56 and two opposing catches 57 respectively located on the two stand bars 56, and dents 69 are respectively located at opposing side surfaces of the two catches 57, and the stand bars 56 can be driven by the motors 54 to move back and forth along the guide tracks 52 to drive the two catches 57 close to or depart from each other and to close the two dents 69 to form a hole or to open the two dents 69, and a needle 48 to be cleaned is moved between the two dents 69 when the two dents 69 are opened and next, the two catches 57 are moved to close to each other by driven with the two motors 54 until the needle 48 to be cleaned is accommodated in the hole formed by the two dents 69, and then the needle 48 to be cleaned is moved outward along a hole axis line, the catches 57 scrape residual sealant on the needle 48 to be cleaned during the process that the needle 48 to be cleaned is moved outward to accomplish a cleaning action for the needle 48 to be cleaned.

The sealant coating device further comprises: a platform 20, and an outer frame 30 located at periphery of the platform 20, and the coating assembly 40 is installed on the outer frame 30, and the platform 20 fixes the substrate by vacuum suction; the coating assembly 40 comprises a portal frame 42 installed on the outer frame 30 and two coating head 44 symmetrically installed on the portal frame 42; the guide tracks 52 of the needle clean device 50 are installed on the outer frame 30 relative to the coating assembly 40.

In this embodiment, the sealant coater having the needle clean device comprises two needle clean devices 50, and the two needle clean devices 50 are symmetrically installed in middle positions of two opposing sides of the outer frame 30.

The platform 20 fixes the substrate by vacuum suction. The portal frame 42 comprises two mounting supports and coating head installation parts connected to the two mounting supports (not shown), and lengths of the coating head installation part is larger than a distance between the two needle clean devices 50. This ensures that the two coating heads 44 can be moved to contact the needle clean devices 50, i.e. that the needles 48 to be cleaned of the coating heads 44 can be inserted in the needle clean devices 50. The two mounting supports of the portal frame 42 at the two opposing sides of the outer frame 30 respectively comprise a coating device guide track 80, and the portal frame 42 is installed on the outer frame 30 with the two coating device guide tracks 80, and the portal frame 30 is moved back and forth on the coating device guide track 80 along a first direction (as Y axis is illustrated and shown in FIG. 6), and the two coating heads 44 are moved back and forth on the portal frame 42 along a second direction (as X axis is illustrated and shown in FIG. 6) which is perpendicular to the first direction, and the coating heads 44 are moved up and down on the portal frame 42 along a direction (as Z axis is illustrated and shown in FIG. 6) perpendicular to a plane constructed by the first direction and the second direction.

The needle clean device 50 further comprises a container 58 between the two guide tracks 52, and the container 58 is employed to accept the residual sealant scraped down from the needle 48 to be cleaned. The container 58 can be taken out of the needle clean device 50 and cleaned alone. The material of the catches 57 is no dust plastics to prevent the influence to the production quality due to the generated dust in use.

Specifically, each of the catches 57 comprises: a connecting part 62 which one end is connected to the stand bar 56 and a cleaning part 64 which is connected to the other end of the connecting part 62, and each of the cleaning part 64 comprises a bottom part 66 and a top part 68 connecting to the bottom part 66, and opposing side surfaces of the two bottom parts 66 of the cleaning parts 64 are cants. In the present invention, the opposing side surfaces of the two bottom parts 66 of the cleaning parts 64 comprise certain cants. As long as the certain cants capable of allowing the scraped sealant dropped with the cants by gravity and preventing the scraped sealant to be accumulated at places where the catches 57 and the needle 48 to be cleaned can touch, the clean effect will not be influenced.

In this embodiment, the two bottom parts of the two cleaning parts preferably have wedge appearances. The two dents 69 are respectively located at the middle of the opposing side surfaces of the two top parts 68 of the cleaning parts 64. The two dents 69 appear as symmetric semicircles. The two dents are closed to form a hole when the two catches close to each other. The aperture of the hole formed by the two closed dents is larger than a diameter of the needle to be cleaned to prevent the damage to the needle 48 to be cleaned when the catches 57 are closed.

In conclusion, in the needle clean device and the sealant coater having the device, by utilizing the needle clean device located on the outer frame and utilizing the catches to automatically scrape the sealant accumulated on the needle after a certain amount of substrate is coated by settings without manual clean and raise the work efficiency. Meanwhile, the particle issue caused by opening the door of the coater to clean the needles can be diminished and the bad influence to the productions due to the sealant accumulated on the needles of the sealant coater can be reduced. The production quality is promoted.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A needle cleaning device, comprising two opposing guide tracks, two stand bars respectively and slidably installed on the two opposing guide tracks, two motors respectively fixedly connected to the two stand bars and two opposing catches respectively located on the two stand bars, and two dents are respectively located at opposing side surfaces of the two opposing catches, and the two stand bars can be driven by the two motors to move back and forth along the guide tracks to drive the two opposing catches close to or depart from each other and to close the two dents to form a hole or to open the two dents, and a needle to be cleaned is moved between the two dents when the two dents are opened and next, the two opposing catches are moved close to each other by driving with the two motors until the needle to be cleaned is accommodated in the hole formed by the two dents, and then the needle to be cleaned is moved outward along a hole axis line, the two opposing catches scrape residual sealant on the needle to be cleaned during the process that the needle to be cleaned is moved outward to accomplish a cleaning action for the needle to be cleaned.

2. The needle cleaning device according to claim 1, wherein each of the two opposing catches comprises: a connecting part which one end is connected to the stand bar and a cleaning part which is connected to the other end of the connecting part, and each of the cleaning part comprises a bottom part and a top part connecting to the bottom part, and opposing side surfaces of the two bottom parts of the cleaning parts are cants, and the two dents are respectively located at the middle of the opposing side surfaces of the two top parts of the cleaning parts, and the two bottom parts of the two cleaning parts have wedge appearances, and the two dents appear as symmetric semicircles.

3. The needle cleaning device according to claim 1, wherein material of the two catches is no dust plastics and an aperture of the hole formed by the two closed dents is larger than a diameter of the needle to be cleaned.

4. The needle cleaning device according to claim 1, further comprising a container between the two opposing guide tracks, and the container is employed to accept the residual sealant scraped down from the needle to be cleaned.

5. A sealant coater having a needle cleaning device, comprising: a sealant coating device and the needle cleaning device located on the sealant coating device, and the sealant coating device comprises a coating assembly, and the coating assembly comprises a coating head, and the coating head comprises a syringe and a needle installed at one end of the syringe; the needle cleaning device comprises two opposing guide tracks, two stand bars respectively and slidably installed on the two opposing guide tracks, two motors respectively fixedly connected to the two stand bars and two opposing catches respectively located on the two stand bars, and two dents are respectively located at opposing side surfaces of the two opposing catches, and the two stand bars can be driven by the two motors to move back and forth along the guide tracks to drive the two opposing catches close to or depart from each other and to close the two dents to form a hole or to open the two dents, and a needle to be cleaned is moved between the two dents when the two dents are opened and next, the two opposing catches are moved close to each other by driving with the two motors until the needle to be cleaned is accommodated in the hole formed by the two dents, and then the needle to be cleaned is moved outward along a hole axis line, the two opposing catches scrape residual sealant on the needle to be cleaned during the process that the needle to be cleaned is moved outward to accomplish a cleaning action for the needle to be cleaned.

6. The sealant coater having the needle cleaning device according to claim 5, wherein the sealant coating device further comprises: a platform, and an outer frame located at periphery of the platform, and the coating assembly is installed on the outer frame, and the platform fixes a substrate by vacuum suction; the coating assembly comprises a portal frame installed on the outer frame and two coating head symmetrically installed on the portal frame; the two opposing guide tracks of the needle cleaning device are installed on the outer frame relative to the coating assembly, and the needle cleaning device further comprises a container between the two opposing guide tracks, and the container is employed to accept the residual sealant scraped from the needle to be cleaned.

7. The sealant coater having the needle cleaning device according to claim 6, wherein the sealant coater having the needle cleaning device comprises two needle cleaning devices, and the two needle cleaning devices are symmetrically installed in middle positions of two opposing sides of the outer frame; the portal frame comprises two mounting supports and coating head installation parts connected to the two mounting supports, and lengths of the coating head installation part is larger than a distance between the two needle cleaning devices.

8. The sealant coater having the needle cleaning device according to claim 7, wherein the two mounting supports of the portal frame at the two opposing sides of the outer frame respectively comprise a coating device guide track, and the portal frame is installed on the outer frame with the two coating device guide tracks, and the portal frame is moved back and forth on the coating device guide track along a first direction, and two coating heads are moved back and forth on the portal frame along a second direction which is perpendicular to the first direction, and the two coating heads are moved up and down on the portal frame along a direction perpendicular to a plane constructed by the first direction and the second direction.

9. The sealant coater having the needle cleaning device according to claim 6, wherein each of the two opposing catches comprises: a connecting part which one end is connected to the stand bar and a cleaning part which is connected to the other end of the connecting part, and each of the cleaning part comprises a bottom part and a top part connecting to the bottom part, and opposing side surfaces of the two bottom parts of the cleaning parts are cants, and the two dents are respectively located at the middle of the opposing side surfaces of the two top parts of the cleaning parts, and the two bottom parts of the two cleaning parts have wedge appearances, and the two dents appear as symmetric semicircles.

10. The sealant coater having the needle cleaning device according to claim 5, wherein material of the two catches is no dust plastics and an aperture of the hole formed by the two closed dents is larger than a diameter of the needle to be cleaned.

11. A sealant coater having a needle cleaning device, comprising: a sealant coating device and the needle cleaning device located on the sealant coating device, and the sealant coating device comprises a coating assembly, and the coating assembly comprises a coating head, and the coating head comprises a syringe and a needle installed at one end of the syringe; the needle cleaning device comprises two opposing guide tracks, two stand bars respectively and slidably installed on the two opposing guide tracks, two motors respectively fixedly connected to the two stand bars and two opposing catches respectively located on the two stand bars, and two dents are respectively located at opposing side surfaces of the two catches, and the two stand bars can be driven by the two motors to move back and forth along the guide tracks to drive the two opposing catches close to or depart from each other and to close the two dents to form a hole or to open the two dents, and a needle to be cleaned is moved between the two dents when the two dents are opened and next, the two opposing catches are moved close to each other by driving with the two motors until the needle to be cleaned is accommodated in the hole formed by the two dents, and then the needle to be cleaned is moved outward along a hole axis line, the two opposing catches scrape residual sealant on the needle to be cleaned during the process that the needle to be cleaned is moved outward to accomplish a cleaning action for the needle to be cleaned;

wherein the sealant coating device further comprises: a platform, and an outer frame located at periphery of the platform, and the coating assembly is installed on the outer frame, and the platform fixes a substrate by vacuum suction; the coating assembly comprises a portal frame installed on the outer frame and two coating head symmetrically installed on the portal frame; the two opposing guide tracks of the needle cleaning device are installed on the outer frame relative to the coating assembly, and the needle cleaning device further comprises a container between the two opposing guide tracks, and the container is employed to accept the residual sealant scraped from the needle to be cleaned.

12. The sealant coater having the needle cleaning device according to claim 11, wherein the sealant coater having the needle cleaning device comprises two needle cleaning devices, and the two needle cleaning devices are symmetrically installed in middle positions of two opposing sides of the outer frame; the portal frame comprises two mounting supports and coating head installation parts connected to the two mounting supports, and lengths of the coating head installation part is larger than a distance between the two needle cleaning devices.

13. The sealant coater having the needle cleaning device according to claim 11, wherein each of the catches comprises: a connecting part which one end is connected to the stand bar and a cleaning part which is connected to the other end of the connecting part, and each of the cleaning part comprises a bottom part and a top part connecting to the bottom part, and opposing side surfaces of the two bottom parts of the cleaning parts are cants, and the two dents are respectively located at the middle of the opposing side surfaces of the two top parts of the cleaning parts, and the two bottom parts of the two cleaning parts have wedge appearances, and the two dents appear as symmetric semicircles.

14. The sealant coater having the needle cleaning device according to claim 11, wherein material of the two catches is no dust plastics and an aperture of the hole formed by the two closed dents is larger than a diameter of the needle to be cleaned.

15. The sealant coater having the needle cleaning device according to claim 11, wherein the two mounting supports of the portal frame at the two opposing sides of the outer frame respectively comprise a coating device guide track, and the portal frame is installed on the outer frame with the two coating device guide tracks, and the portal frame is moved back and forth on the coating device guide track along a first direction, and two coating heads are moved back and forth on the portal frame along a second direction which is perpendicular to the first direction, and the two coating heads are moved up and down on the portal frame along a direction perpendicular to a plane constructed by the first direction and the second direction.

* * * * *